US006516797B2

(12) United States Patent
Chen-Lieh

(10) Patent No.: US 6,516,797 B2
(45) Date of Patent: Feb. 11, 2003

(54) BREATHING STRUCTURE OF SNORKELING APPARATUS

(75) Inventor: Pan Chen-Lieh, Ilan Hsing (TW)

(73) Assignee: QDS Injection Molding LLC, San Diego, CA (US)

( * ) Notice: Subject to any disclaimer, the term of this patent is extended or adjusted under 35 U.S.C. 154(b) by 0 days.

(21) Appl. No.: 09/813,312

(22) Filed: Mar. 21, 2001

(65) Prior Publication Data

US 2002/0134380 A1 Sep. 26, 2002

(51) Int. Cl.[7] ..... B63C 11/16
(52) U.S. Cl. ..... 128/201.11; 128/201.28
(58) Field of Search ..... 128/201.11, 201.27, 128/201.28

(56) References Cited

U.S. PATENT DOCUMENTS 3,860,042 A * 1/1975 Green ..... 128/201.11
4,793,341 A * 12/1988 Arasmith ..... 128/201.11
4,805,610 A * 2/1989 Hunt ..... 128/201.11
4,872,453 A * 10/1989 Christianson ..... 128/201.11
4,877,022 A * 10/1989 Christianson ..... 128/201.11
4,928,710 A * 5/1990 Campbell ..... 128/201.11
5,261,396 A * 11/1993 Faulconer et al. ..... 128/201.11
5,487,379 A * 1/1996 Koshiishi ..... 128/201.27
5,657,746 A * 8/1997 Christianson ..... 128/201.11
6,318,363 B1 * 11/2001 Monnich ..... 128/201.11

* cited by examiner

*Primary Examiner*—Aaron J. Lewis
(74) *Attorney, Agent, or Firm*—Troxell Law Offices PLLC

(57) ABSTRACT

A breathing structure of snorkeling apparatus of present invention is characterized in that a ventilating valve is provided between a space formed by tube body under main tube with main body under mouthpiece and above exhaust valve, the ventilating valve includes a valve seat and a valve plate, a through hole connecting with main tube is provided on the valve seat, the valve plate which can cover the through hole and its specific body; the structure of the valve plate is designed to form movement by means of closing as blowing and opening as sucking, which can make snorkelers breathe fully. A recess provided on the main body, which is a stagnant position as the valve plate being floated off. The specific gravity of the valve plate for ventilating valve is between 0.95–0.2.

5 Claims, 3 Drawing Sheets

BREATHING STRUCTURE OF SNORKELING APPARATUS

FIELD OF THE INVENTION

The invention relates to a breathing structure of snorkeling apparatus and more specifically to a breathing system of fresh air for snorkelers.

BACKGROUND OF THE INVENTION

The basic constitution of a conventional snorkeling apparatus (as shown in FIG. 1) includes a mouthpiece A, a main tube B and an exhaust valve C etc, there are following problems when which is in use.

1. When a "blowing " state of snorkeling apparatus is used by snorkelers, the gas accumulated in the main tube B of snorkeling apparatus is a gas blowing out by mouthpiece A, i.e. a gas in which more carbon dioxide is contained, and when it's in "sucking" state, the "exhausted gas" in the main tube B is first of all sucked in, the fresh air entering from outside of tube body would be then sucked in; the "blowing", "sucking" air of such state consumes easily the strength of snorkelers and specifically the user with less vital capacity.
2. When snorkelers enter the water in the beginning, the water is usually filled in the snorkeling apparatus, therefore, who blow off first a mouthful of gas, the water in snorkeling apparatus is discharged from the exhaust valve C and the air inlet of the main tube B; usually, the water cannot be entirely discharged out of the snorkeling apparatus after this blowing action, and water still remains in the snorkeling apparatus, in a using state. This water cannot be easily discharged from the exhaust valve C unless the blowing is powerful.
3. Usually, in the time of using snorkeling apparatus sprays are mostly not large, although a structure blocking the water which is entered from air inlet, is provided in the end of main tube B, but the water is usually still accumulated in tube; a small space is generally preset under the mouthpiece A, and an exhaust valve C is provided under the space, the water is accumulated at the space, the water is discharged out of the exhaust valve C by means of a powerful blowing; but, air enters/exits easily into/out of air inlet/outlet, because the water pressure outside of exhaust valve C (under water plane) is large, therefore, the effect discharging water is not good, specifically at the time in which the blowing is not powerful, the water is only flowed in tube. Such phenomenon accumulating water in snorkeling apparatus will prevent often breathing of snorkelers.

SUMMARY OF THE INVENTION

The object of the present invention is to provide a breathing structure of snorkeling apparatus, in order to improve the above-mentioned defects, the structure can make the snorkelers breathe fully when which is in use, the sucked air is mostly fresh air, the exhausted air can be mostly discharged out of the snorkeling apparatus at the blowing time.

Embodying the above-mentioned object of present invention adopts technical solutions as below: the breathing structure of snorkeling apparatus includes mainly a main tube, which is a hollow tube body, upside is opened, downside is tightly connected in main body; a main body, which is a hollow body and has three openings with different directions, i.e. mouthpiece direction, exhaust valve direction and ventilating valve direction; a mouthpiece, which is blowing and sucking opening of snorkelers; an exhaust valve, which is a valve body of water and air outlet; a ventilating valve is provided between a space formed by tube body under main tube with main body under mouthpiece and above exhaust valve, the ventilating valve includes a valve seat and a valve plate, a through hole connecting with main tube is provided on the valve seat, the valve plate which can cover the through hole and its specific gravity is lighter than water, is a constitutional body; the structure of the valve plate is designed to form movement by means of closing as blowing and opening as sucking, which can make snorkelers breathe fully; a recess provided on the main body which is a stagnant position as the valve plate being floated off; the specific gravity of the valve plate for ventilating valve is between 0.95~0.2.

The ventilating valve device of the present invention includes at least a valve seat and a valve plate, wherein the valve plate is a structure in which its specific gravity is lower than water, which can be made from the material with lower density, can also be formed in combination with constitutional body in which there is water, the valve plate will be automatically floated off in the form of presetting state by means of characteristic for its specific gravity lower than water, at that time the level in snorkeling apparatus is higher than ventilating valve. The ventilating valve device of present invention can include a valve seat, a valve plate and a recess provided at the arisen position of valve plate, the recess is to provide a stagnant position of valve plate when its arisen angle is larger than 90°.

The snorkeling apparatus provided with ventilating valve device of present invention has functionally following characteristics, such as:

1. when the level accumulated water in snorkeling apparatus is lower than ventilating valve, the blown air from snorkelers makes ventilating valve in the form of tightly closing, the blown air (exhausted gas) is discharged by exhaust valve; in such state, the blown gas is only remained between "space" formed by ventilating valve with main body under mouthpiece and above exhaust valve, and fresh air is in snorkeling apparatus above ventilating valve; ventilating valve is opened when snorkelers is in sucking, the sucking gas of snorkelers is fresh air, except for a few exhaust gas remained in above-mentioned "space";
2. when the level in snorkeling apparatus is over the ventilating valve, the valve is automatically opened and makes valve plate remain in preset position, snorkelers can make water in snorkeling apparatus discharge from exhaust valve and air inlet with whose powerful blowing; and valve plate will be fallen down when blowing force is reduced to a certain extent.
3. when a few water in snorkeling apparatus make ventilating valve in the form of a little opening, air is entered into that small space from mouthpiece as snorkelers in blowing, valve plate will be closed by press of air after a few waters are moved, waters are mostly discharged with blown air at exhaust valve; the few waters can mostly be discharged after blowing for one or two times.

The breathing structure of snorkeling apparatus for present invention is now further described in combination with embodyment shown in drawings, wherein

DETAILED DESCRIPTION OF A PREFERRED EMBODIMENT

Figure 1:
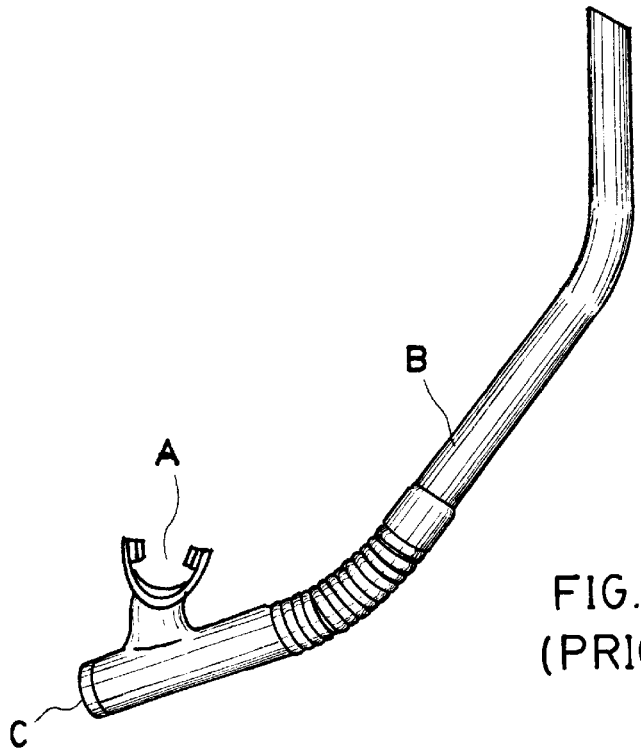
FIG. 1 (PRIOR ART)
FIG. 1 is a structure of conventional snorkeling apparatus.
Figure 2:
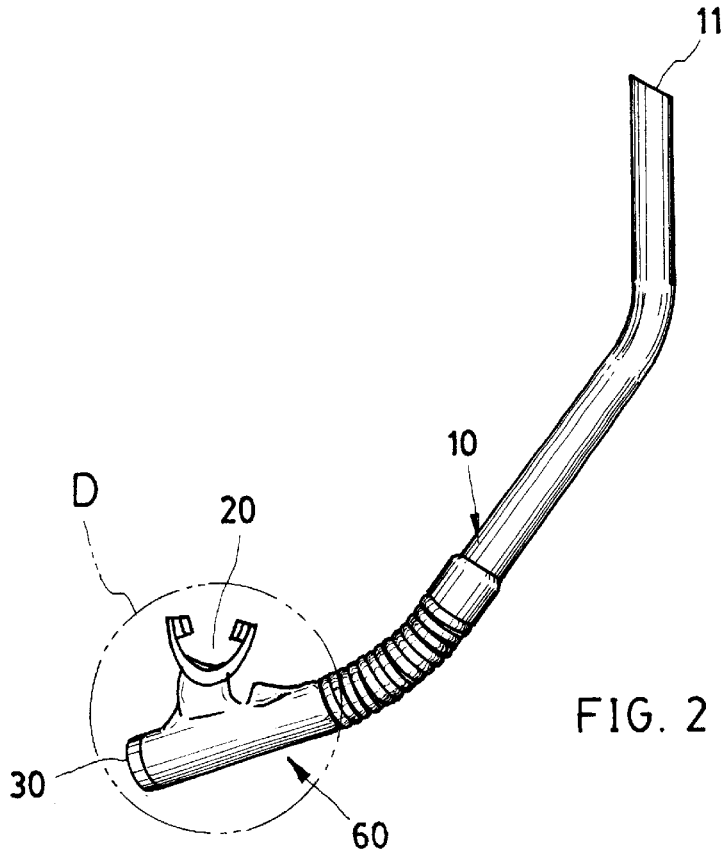
FIG. 2 is a structure of snorkeling apparatus for the present invention.
Figure 3:
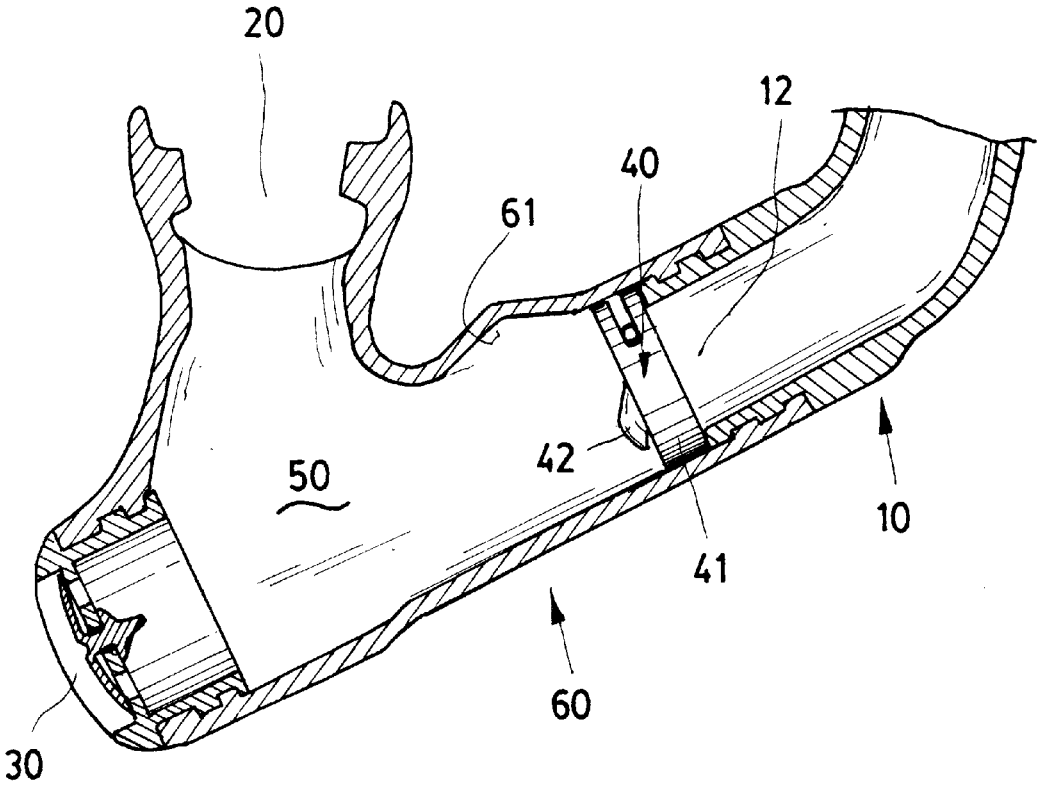
FIG. 3 is an enlarged sectional view of area D shown in FIG. 2.

As shown in FIGS. 2, 3, the constitution of present invention includes mainly main tube 10, mouthpiece 20, exhaust valve 30 and ventilating valve 40 etc; between ventilating valve 40, mouthpiece 20 and exhaust valve 30 is a space 50.

Above-mentioned constitution can be divided into main tube 10 and main body 60 in manufacturing; part for main body 60 includes mouthpiece 20, exhaust valve 30 and ventilating valve 40. The main tube 10 is as same as main tube of conventional snorkeling apparatus, which is hollow tubular body, an opening 11 is provided in upside, which can provide air passage and can discharging water in main tube 10 and main body 60. Upside of main tube 10 is as same as conventional snorkeling apparatus, a device preventing entrance from water can be provided.

The mouthpiece 20 is as same as prior mouthpiece of snorkeling apparatus, which is a constitution provided for entering/exhausting air from mouth.

The exhaust valve 30 is as same as discharging water valve structure of prior snorkeling apparatus, which can provide discharging water and air in space 50 by means of air pressure, and is immediately automatically closed after discharging water (gas) by reasons of material, structural design and water pressure. The lower end 12 of main tube 10 is connected with main body 60 in the form of tight state.

As shown in FIG. 3, main body 60 is a hollow body which has three outlets with different directions, which are respectively part of mouthpiece 20, part of exhaust valve 30 and part of ventilating valve 40; a recess 61 is provided on the main body 60 located at a place adjoining ventilating valve 40.

Figure 4:
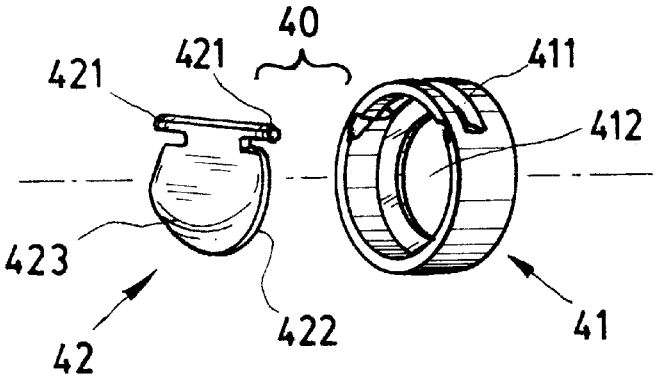
FIG. 4 is an exploded perspective view of ventilating valve.
Figure 5:
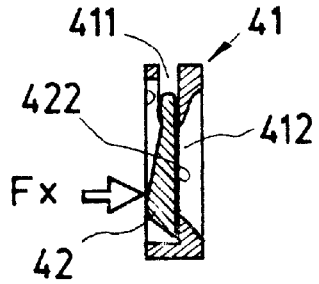
FIG. 5 is a sectional view for closing state of ventilating valve.
Figure 6:
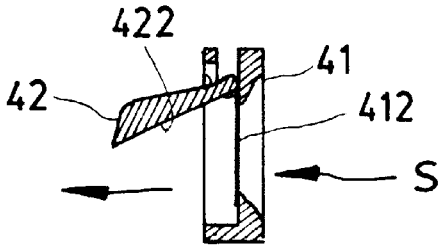
FIG. 6 is a sectional view for sucking state of ventilating valve.
Figure 7:
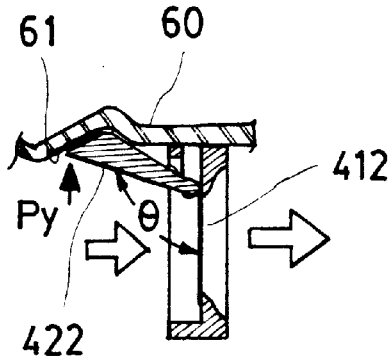
FIG. 7 is a sectional view of ventilating state in full water state.

As shown in FIG. 4, the constitution of ventilating valve 40 includes a valve seat 41 and a valve plate 42; valve seat 41 can tightly be provided on main body 60 for lower end 12 of main tube 10, the constitution of valve seat 41 includes a groove 411 and a through hole 412; the constitution of valve plate 42 includes an axle 421 and a plate face 422, other face of plate face 422 is designed with a form of projection 423 (for increasing buoyancy); valve plate 42 is constitutional body with specific gravity lower than water, the specific gravity of valve plate 42 can be between 0.95–0.2, in order to increase sensitivity for floating up; the axle 421 of valve plate 42 is provided on the groove 411 of the valve seat 42, the through hole 412 is a passage of air and water between main tube 10 and space 50; above-mentioned constitution forms a state which can make a movement as positions shown in FIGS. 5, 6, 7.

As shown in FIG. 5 is a state as ventilating valve 40 in blowing, force Fx formed by blown air from part of mouthpiece 20 makes plate face 422 of valve plate 42 covering through hole 412, the blown air can only be exhausted from the direction of exhaust valve 30. As shown in FIG. 6 is a state as ventilating valve 40 in sucking, the valve is opened by fresh air S and gravity of valve plate 42, and the valve plate due to flowing is a little upwards risen, plate face 422 covers not through hole 412, air S is flowed from main tube 10 to direction of mouthpiece 20.

As shown in FIG. 7 is a state as water fills the snorkeling apparatus (snorkelers enter the water in the beginning), valve plate 42 due to buoyancy is floated off, and is located at recess 61 of main body 60, its arise angle θ is larger than 90°; in this state, air and water are flowed according to direction shown with arrow by means of blowing from snorkelers, which makes plate face 422 forming a vector Py, valve plate 42 is remained in this position and is not fallen down, the valve plate 42 is only fallen down until the vector Py formed from flowing air or water, is less than gravity of valve plate 42.

The recess 61 in above-mentioned constitution is mainly a space which is easily remaining for valve plate 42, a far less air flowing state is formed in recess 61 and in the form of adherence; which can be without recess 61, if force Py is enough to make valve plate 42 not fall down and is enough to discharge most of water in snorkeling apparatus.

In summary, the structure provided by present invention can make snorkelers full breathing in use, and the sucked air can in more parts be fresh air, the most of exhaust gas can be discharged out of snorkeling apparatus as blowing.

The above-mentioned constitution is only an embodyment, the characteristic of present invention is in that a ventilating valve 40 is provided under main tube, a space 50 is spaced between downside of mouthpiece 20, exhaust valve 30 and ventilating valve 40, the present object is arrived by means of providing ventilating valve 40; in present constitution, analogous constitutions i.e. corresponding technical measure can be substituted for the ventilating valve 40, which belongs still to claimed scope.

What is claimed is:

1. A snorkeling apparatus, comprising:

a) a hollow main body having three openings;

b) an elongated, hollow tube communicating with a first of the three openings, the main tube having an upper opening;

c) a mouthpiece communicating with a second of the three openings;

d) an exhaust valve located in a third of the three openings; and e) a ventilating valve assembly including a valve seat in communication with the first of the three openings and a buoyant valve plate pivotally moveable between a closed position, wherein the valve plate is in contact with the valve seat, and an opened position, wherein the valve plate is displaced away from the valve seat, pivotal movement of the valve plate between the closed and opened positions being greater than 90°, whereby water in the main body and the main tube moves the valve plate to the opened position.

2. The snorkeling apparatus of claim 1 wherein the valve plate has a specific gravity of between 0.95–0.2.

3. The snorkeling apparatus of claim 1, further comprising a recess formed in the main body and located such that the valve plate enter the recess when in the opened position.

4. The snorkeling apparatus of claim 1 further comprising:

a) a groove in the valve seat; and, b) an axle on the valve plate engaging the groove such that the valve plate is pivotally movable with respect to the valve seat.

5. The snorkeling apparatus of claim 1 wherein the valve plate has a first side which contacts the valve seat when the valve plate is in the closed position and a second side opposite to the first side, and further comprising a projection projecting from the second side of the valve plate.

* * * * *